US011564490B1

(12) United States Patent
Searles

(10) Patent No.: US 11,564,490 B1
(45) Date of Patent: Jan. 31, 2023

(54) CORNER STORAGE DEVICE WITH SLIDING STORAGE PANELS

(71) Applicant: Geoffrey A. Searles, Grafton, MA (US)

(72) Inventor: Geoffrey A. Searles, Grafton, MA (US)

( * ) Notice: Subject to any disclaimer, the term of this patent is extended or adjusted under 35 U.S.C. 154(b) by 0 days.

(21) Appl. No.: 17/528,622

(22) Filed: Nov. 17, 2021

Related U.S. Application Data

(60) Provisional application No. 63/115,147, filed on Nov. 18, 2020.

(51) Int. Cl.
*A47B 81/00* (2006.01)
*A47B 46/00* (2006.01)
*B25H 3/04* (2006.01)

(52) U.S. Cl.
CPC ..... *A47B 81/002* (2013.01); *A47B 46/00* (2013.01); *B25H 3/04* (2013.01)

(58) Field of Classification Search
CPC ..... A47B 81/00; A47B 81/002; A47B 81/005; A47B 46/00; A47B 61/02; A47B 88/42; A47B 88/0485; A47B 77/10; A47B 77/14; A47B 77/16; B25H 3/028; B25H 3/04
See application file for complete search history.

(56) References Cited

U.S. PATENT DOCUMENTS 5,662,398 A * 9/1997 Swallow ..... A47B 67/04 312/238
5,740,910 A * 4/1998 Ueng ..... A47B 96/068 312/902
6,135,584 A * 10/2000 Happ ..... B25H 3/04 312/334.25
8,002,366 B2 * 8/2011 Fitz ..... A47B 88/944 312/348.4
2001/0028208 A1 * 10/2001 Reilly ..... B25H 3/028 312/286

FOREIGN PATENT DOCUMENTS

DE 102006021792 A1 * 11/2007 ..... A47B 88/00
DE 202020002612 U1 * 8/2020
KR 2020140000265 U * 1/2014 ..... A47B 61/00
WO WO-2020252351 A1 * 12/2020

OTHER PUBLICATIONS en.wikipedia.org, "Perforated Hardboard," Apr. 22, 2021, retrieved Aug. 19, 2022 from URL <http://web.archive.org/web/20210422044328/https://en.wikipedia.org/wiki/Perforated_hardboard>, 4 pages.

* cited by examiner

*Primary Examiner* — Andrew M Roersma
(74) *Attorney, Agent, or Firm* — Fish & Richardson P.C.

(57) ABSTRACT

A corner storage device that includes a top piece that includes a left wall side, a right wall side, and a diagonal opening side. The left wall side and the right wall side together substantially form a right angle at a corner of the corner storage device, and the diagonal opening side is not parallel to the left wall side and not parallel to the right wall side. The corner storage device further includes panel guides that are coupled to the top piece and substantially parallel to each other, and storage panels that are slidably coupled to the panel guides. Each of the storage panels is configured to slide between a close position where the storage panel does not extend beyond the diagonal opening side and an open position where the storage panel extends beyond the diagonal opening side.

17 Claims, 2 Drawing Sheets

CORNER STORAGE DEVICE WITH SLIDING STORAGE PANELS

CROSS-REFERENCE TO RELATED APPLICATIONS

This application claims priority to U.S. Patent Application Ser. No. 63/115,147, filed on Nov. 18, 2020, the entire contents of which are hereby incorporated by reference.

BACKGROUND

A home owner may own many yard and garden tools. These tools may be stored in various ways. For example, some home owners may store the tools in a shed that is separate from a house. Some other home owners may lean the tools against walls of a garage. Still other home owners may throw the tools in a pile in a corner of a garage.

SUMMARY

According to an aspect of the subject matter disclosed by this specification, a corner storage device with sliding storage panels is disclosed. The corner storage device may store tools in a compact space that is easily accessed. For example, the corner storage device may fit in a corner of a garage. The corner storage device may include a number of storage panels that may each store tools. For example, each of the storage panels may include hooks on which tools may be hung. The storage panels may individually slid out of the corner storage unit to allow easier access to the tools, and then individually slid back into the corner storage unit to reduce an amount of space taken by the storage panels.

In one implementation, a corner storage device includes a top piece that includes a left wall side, a right wall side, and a diagonal opening side. The left wall side and the right wall side together substantially form a right angle at a corner of the corner storage device. The diagonal opening side is not parallel to the left wall side and not parallel to the right wall side. The corner storage device includes panel guides that are coupled to the top piece and storage panels that are slidably coupled to the top piece by the panel guides. Each of the storage panels is configured to slide between a close position where the storage panel does not extend beyond the diagonal opening side and an open position where the storage panel extends beyond the diagonal opening side.

These and other versions each may optionally include one or more of the following features. In certain aspects the storage panels include a first storage panel, that is closer to a middle of the top piece than a second storage panel, that is longer than the second storage panel. In some aspects the storage panels increase in length the closer the storage panel is to a middle of the top piece. In some implementations, each of the panel guides extend between the diagonal opening side and one of: the left wall side or the right wall side. In certain aspects, the storage panels slide in a direction that is substantially perpendicular to the diagonal opening side.

In some aspects, each of the panel guides has a length that is substantially similar to a length of the storage panel coupled to the panel guide. In some implementations, the corner storage device includes a bottom piece that includes second panel guides and the storage panels are slidably coupled to the bottom piece by the second panel guides. In certain aspects, the bottom piece is similarly shaped to the top piece. In some aspects, the corner storage device includes a left wall piece and a right wall piece, where the top piece and the bottom piece are both connected to the left wall piece and the right wall piece.

In some implementations, the corner storage device includes a left front piece and a right front piece, where the left front piece is parallel to the right wall piece, the right front piece is parallel to the left wall piece, and the diagonal piece extends between the left front piece and the right front piece. In certain aspects, the diagonal opening side defines an opening, and the corner storage device includes one or more doors that are configured to be moved to cover the opening. In some aspects, the one or more doors are configured to uncover the opening by swinging outwards away from the storage panels.

In some implementations, the one or more doors include two doors that are configured to swing outwards away from a middle of the diagonal opening side. In certain aspects, the left wall side and the right wall side have similar lengths. In some aspects, each of the storage panels include hooks that are oriented to hang tools. In some implementations, each of the storage panels defines holes and the hooks that are installed within the holes. In certain aspects, each of the storage panels is rectangular prism shaped.

BRIEF DESCRIPTION OF THE DRAWINGS

Like reference numbers and designations in the various drawings indicate like elements. The components shown here, their connections and relationships, and their functions, are meant to be exemplary only, and are not meant to limit the implementations described and/or claimed in this document.

DETAILED DESCRIPTION

Figure 1:
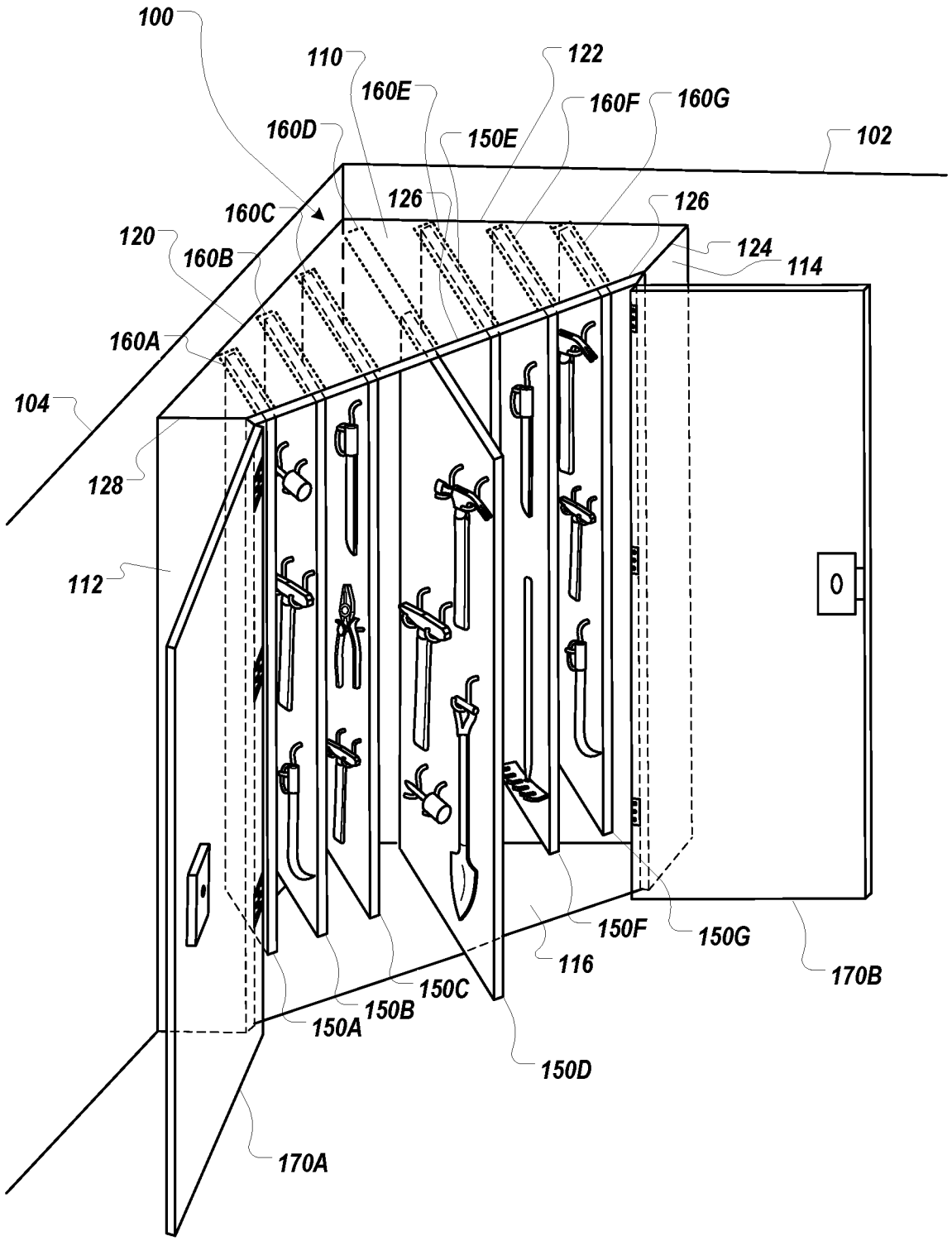
FIG. 1 illustrates a perspective view of an example corner storage unit with a single storage panel slid out.

FIG. 1 illustrates a perspective view of an example corner storage unit 100 with a single storage panel 150D slid out. For context, the corner storage unit 100 is shown in a corner of a garage formed by a left wall 104 of the garage and a right wall 102 wall of the garage.

The corner storage unit 100 may include a top piece 110, a left wall piece, a right wall piece, a left front piece 112, a right front piece 114, and a bottom piece 116. The top piece 110, the left wall piece, the right wall piece, the left front piece 112, the right front piece 114, and the bottom piece 116 may enclose a space that is accessible through an opening.

For example, the top piece 110 and bottom piece 116 may be horizontally oriented and parallel to each other, and the left wall piece, the right wall piece, the left front piece 112, and the right front piece 114 may be vertically oriented, where the left wall piece and the right front piece 114 are parallel to each other, and the right wall piece and the left front piece 112 are parallel to each other. In the example, the top piece 110 and the bottom piece 116 may both be connected to the left wall piece and the right wall piece.

The top piece 110 may include a left wall side 120, a right wall side 122, a right front side 124, a diagonal opening side 126, and a left front side 128. The left wall side 120 and the right wall side 122 may together substantially form a right angle at a corner of the corner storage device 100, and the diagonal opening side 126 may be not parallel to the left wall side 120 and not parallel to the right wall side 122. For example, the top piece 110 may be shaped like a right triangle with the two corners that don't have a right angle cut off a same amount so the left wall side 120 and the right wall side 122 have a same length. The diagonal opening side 126 may extend between the left front piece 112 and the right front piece 114.

The corner storage unit 100 may include panel guides 160A-160G (collectively referred to as 160) coupled to the top piece 110. For example, the panel guides 160 may be drawer slides with an outer member fastened by screws to an underside of the top piece 110. The panel guides 160 may be positioned substantially parallel to one another. The panel guides 160 may extend between the diagonal opening side 126 and one of the left wall side 120 or the right wall side 122. For example, a direction that the panel guides 160 extends and the wall sides 120, 122 may form approximately 45° angles.

The corner storage unit 100 may include storage panels 150A-G (collectively referred to as 150). While FIG. 1 shows the corner storage unit 100 including seven storage panels 150, the corner storage unit 100 may include fewer or more storage panels. The storage panels 150 may be rectangular prism shaped. For example, each of the storage panel may be a wooden board.

Each of the storage panels 150 may be configured to store tools. For example, each of the storage panels 150 may hang multiple tools. In some implementations, the storage panels 150 may include hooks that are oriented to hang hooks. For example, each of the storage panels 150 may include a hook where an opening of the hook is facing upwards. In some implementations, each of the storage panels 150 defines holes and the hooks are installed within the holes. For example, the storage panels 150 may include a grid of holes and the hooks may be removably installed within the holes as desired by a person. The hooks may be positioned on both sides of each of the storage panels 150. For example, both sides of the storage panels with the largest surface areas may have grids of holes in which hooks may be installed.

The storage panels 150 may be slidably coupled to the top piece 110 by the panel guides 160. For example, where the panel guides 160 are drawer slides, an inner member of each of the drawer slides may be fastened by screws to a top side of a corresponding storage panel of the storage panels 150. Each of the storage panels 150 may be configured to slide between a close position where the storage panel does not extend beyond the diagonal opening side 126 and an open position where the storage panel extends beyond the diagonal opening side 126.

For example, the panel guides 160 may be oriented so their longest sides extend in a perpendicular direction to a direction that the diagonal opening side 126 extends and the storage panels 150 slide in a direction that is substantially perpendicular to the diagonal opening side 126. The close position for a storage panel may be where the panel guide connected to the storage panel is not extended and the open position may be where the panel guide connected to the storage panel is extended.

The storage panels 150 may include a first storage panel, that is closer to a middle of the top piece than a second storage panel, that is longer than the second storage panel. For example, the storage panel 150D may be longer than the storage panel 150A in a direction that the storage panels 150 slide.

In some implementations, the storage panels increase in length the closer the storage panel is to a middle of the top piece. For example, in a direction that the storage panels 150 slide, the storage panel 150B may be 17 inches, the storage panel 150C may be 31 inches, the storage panel 150D may be 43 inches, the storage panel 150E may be 31 inches, and the storage panel 150F may be 17 inches. In some implementations, the panel guides 160 may have a length that is substantially similar to a length of the storage panel coupled to the panel guide. For example, the panel guides 160 and the storage panels may have lengths that are within three inches of one another.

The storage panels 150 may be configured to slide out angled away from the left wall piece and the right wall piece so that tools may be stored on both sides of the storage panels 150. For example, were the storage panels 150 to slide out parallel to a wall piece, then when the corner storage unit 100 is placed in a corner, tools stored on a side of the storage panels 150 closest to the wall piece would be close to a wall and hard to see and reach.

The storage panels 150 may have different lengths so that an area that tools may be stored may be increased while reducing a size of the corner storage unit 100. For example, were all the storage panels 150 to have a same length as the storage panel 150D, then the doors 170A, 170B would not be able to close all the panels on the sides would extend out of the corner storage unit 100. In another example, were all the storage panels 150 to have a same length as the storage panel 150A, then the area on which tools may be stored on storage panel 150D may be halved.

In some implementations, the bottom piece 116 may include second panel guides and the storage panels 150 may be slidably coupled to the bottom piece 116 by the second panel guides. For example, the bottom piece 116 may be fastened by screws to outer members of a second set of drawer slides that mirror a size and orientation of the panel guides 160, and the inner members of the second panel guides may be fastened by screws to a bottom of the storage panels 150. In some implementations, the bottom piece 116 may be similarly shaped to the top piece 110. For example, the bottom piece 116 may have sides that are each a same size and orientation as the top piece 110.

The corner storage unit 100 may include one or more doors 170 that may be moved to cover and uncover the opening. For example, the doors 170 may swing on hinges on the left front piece 112 and the right front piece 114, and when opening the doors 170 may swing outwards from the storage panels 150 that are stored within the space that is enclosed by the corner storage unit 100. In the example, the doors 170 may also swing outwards from a middle of the diagonal opening side 126.

In some implementations, as seen from a top-down view, the storage panels 150 may be spaced approximately 9 inches from one another, the left front side 128 and the right front side 124 may both be 8 inches, the left wall side 120 and the right wall side 122 may both be 47 inches, and the two doors 170 may each be 2 feet 3 inches long.

While the corner storage unit 100 is shown with the right front piece 112 and the left front piece 114, other implementations may not include the right front piece 112 and the left front piece 114. For example, the corner storage unit 100 may have the top piece 110 be an equilateral right triangle where the diagonal opening side connects to the left wall side 120 and the right wall side 122.

Figure 2:
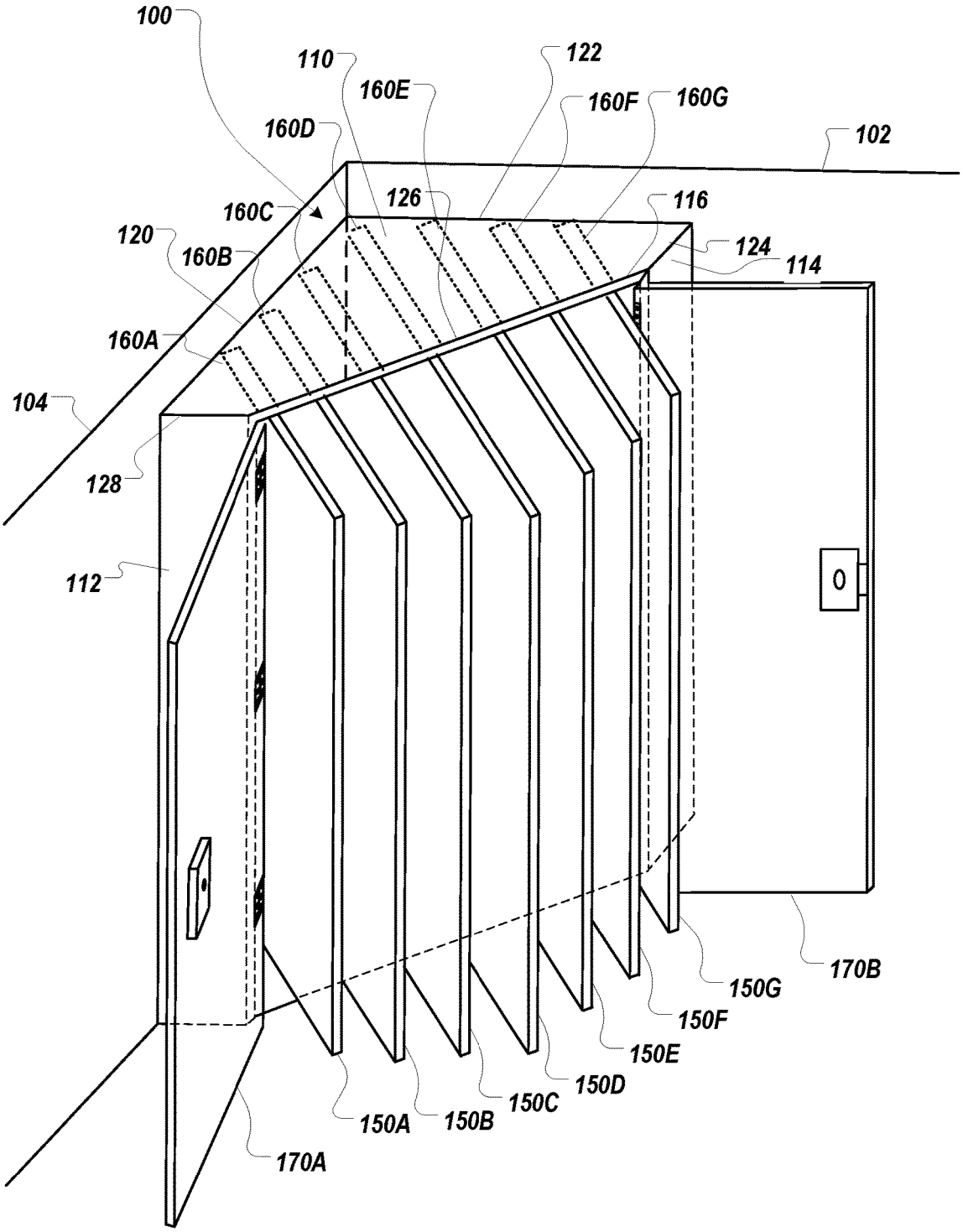
FIG. 2 illustrates a perspective view of an example corner storage unit with all storage panels fully slid out.

FIG. 2 illustrates a perspective view of an example corner storage unit 100 with all storage panels 150 fully slid out. A shown in FIG. 2, the storage panels 150 may slide out different amounts that correspond to the length of each of the storage panel. For example, each of the storage panels 150 may slide out up to two inches from its length While this specification contains many specific implementation details, these should not be construed as limitations on the scope of what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Thus, though particular embodiments of the subject matter have been described. These, and other embodiments, may fall within the scope of the following claims.

What is claimed is:

1. A corner storage device comprising:

a top piece that includes a left wall side, a right wall side, and a diagonal opening side, wherein the left wall side and the right wall side together substantially form a right angle at a corner of the corner storage device, the left wall side has substantially a same length as the right wall side, the diagonal opening side is longer than the left wall side and the right wall side, the diagonal opening side is not parallel to the left wall side and not parallel to the right wall side, and a center axis of the top piece extends between the corner of the corner storage device and a center of the diagonal opening side;

four or more panel guides that are coupled to the top piece; and four or more vertical storage panels that:

are each slidably coupled substantially perpendicularly to the top piece by a respective panel guide from the four or more panel guides, are each at an oblique angle with respect to the left wall side and the right wall side, include one or more first vertical storage panels and one or more second vertical storage panels, the one or more first vertical storage panels are closer to the center axis of the top piece and have a greater depth than the one or more second vertical storage panels, and are each adapted to slide along a corresponding one of the four or more panel guides substantially perpendicularly to the top piece between a closed position where the vertical storage panel does not extend beyond the diagonal opening side of the top piece and an open position where the vertical storage panel extends beyond the diagonal opening side of the top piece.

2. The corner storage device of claim 1, wherein each of the panel guides extend between the diagonal opening side and one of: the left wall side or the right wall side.

3. The corner storage device of claim 1, wherein each of the vertical storage panels slide in a direction that is substantially perpendicular to the diagonal opening side.

4. The corner storage device of claim 1, wherein each of the panel guides has a length that is substantially similar to the depth of the respective vertical storage panel coupled to the respective panel guide.

5. The corner storage device of claim 1, wherein the corner storage device includes a bottom piece that includes second panel guides, and the vertical storage panels are slidably coupled to the bottom piece by the second panel guides.

6. The corner storage device of claim 5, wherein the bottom piece is similarly shaped to the top piece.

7. The corner storage device of claim 5, comprising a left wall piece and a right wall piece, wherein the top piece and the bottom piece are both connected to the left wall piece and the right wall piece.

8. The corner storage device of claim 7, comprising a left front piece and a right front piece, wherein the left front piece is parallel to the right wall piece, the right front piece is parallel to the left wall piece, and the diagonal opening side extends between the left front piece and the right front piece.

9. The corner storage device of claim 8, wherein a combination of the diagonal opening side of the top piece, a bottom diagonal opening side of the bottom piece, the left front piece and the right front piece define an opening, and the corner storage device comprises one or more doors that are configured to be moved to cover the opening.

10. The corner storage device of claim 9, wherein the one or more doors are configured to uncover the opening by swinging outwards away from the vertical storage panels.

11. The corner storage device of claim 9, wherein the one or more doors comprise two doors that are configured to swing outwards away from a middle of the diagonal opening side.

12. The corner storage device of claim 9, wherein:

the top piece comprises a left front side and a right front side each of which: i) is adjacent to a corresponding one of the left front piece or the right front piece and ii) have substantially equal length; and the left wall side and the right wall side are longer than the left front side and the right front side.

13. The corner storage device of claim 9, wherein each of the one or more doors is 27 inches wide.

14. The corner storage device of claim 1, wherein the left wall side and the right wall side have similar lengths.

15. The corner storage device of claim 1, wherein each of the vertical storage panels include hooks that are oriented to hang tools.

16. The corner storage device of claim 15, wherein each of the vertical storage panels defines holes, and the hooks are installed within the holes.

17. The corner storage device of claim 1, wherein each of the vertical storage panels is rectangular prism shaped.

* * * * *